US005609326A

United States Patent [19]

Stearns et al.

[11] Patent Number: 5,609,326

[45] Date of Patent: Mar. 11, 1997

[54] IMPERVIOUS MEMBRANOUS ROOF SNOW FENCE SYSTEM

[76] Inventors: Brian C. Stearns, P.O. Box 802; Alan L. Stearns, 1026 Weeks Hill Rd., both of Stowe, Vt. 05672

[21] Appl. No.: 491,073

[22] Filed: Jun. 16, 1995

[51] Int. Cl.[6] ..... E04H 17/14

[52] U.S. Cl. ..... 256/12.5; 256/1; 256/65; 182/45; 248/237; 52/25

[58] Field of Search ..... 256/12.5, 59, 65, 256/68, 69, 64, 13.1, DIG. 6, 1; 182/45, 113; 248/237, 500, 505; 52/24, 25, 26

[56] References Cited

U.S. PATENT DOCUMENTS

| | | | |
|---|---|---|---|
| 756,884 | 4/1904 | Parry | 52/25 |
| 1,925,263 | 9/1933 | Levow | 52/25 |
| 2,079,768 | 5/1937 | Levow | 52/25 |
| 3,182,762 | 5/1965 | Syak et al. | 256/59 |
| 3,633,862 | 1/1972 | Breen | 256/65 X |
| 3,880,405 | 4/1975 | Brueske | 182/113 X |
| 4,367,864 | 1/1983 | Eldeen | 256/59 |
| 5,431,372 | 7/1995 | Kostelecky | 182/45 X |

FOREIGN PATENT DOCUMENTS

| | | | |
|---|---|---|---|
| 5346055 | 12/1993 | Japan | 52/24 |
| 671063 | 7/1989 | Switzerland | 52/24 |
| 666147 | 2/1952 | United Kingdom | 52/25 |

*Primary Examiner*—Harry C. Kim

*Attorney, Agent, or Firm*—John J. Welch, Jr., Esq.

[57] ABSTRACT

An impervious membranous roof snow fence system consisting of a plurality of flat six sided mounting plates affixed through membranous roofing to a roof deck below. The plates in two embodiments have vertical splines to be received by compartments or sleeves in mounting blocks or in another embodiment threaded vertical posts to be received by vertical holes in mounting blocks where the blocks fit over membranous patches fitted over the plates and fully sealed to the roofing where such patches have slits or holes in them to accommodate the spines or posts. The blocks once fastened to the plates have fastened to them in turn, porous fence flags that support horizontal fence pieces from which there hang vertical fence pieces.

10 Claims, 6 Drawing Sheets

Figure 1:
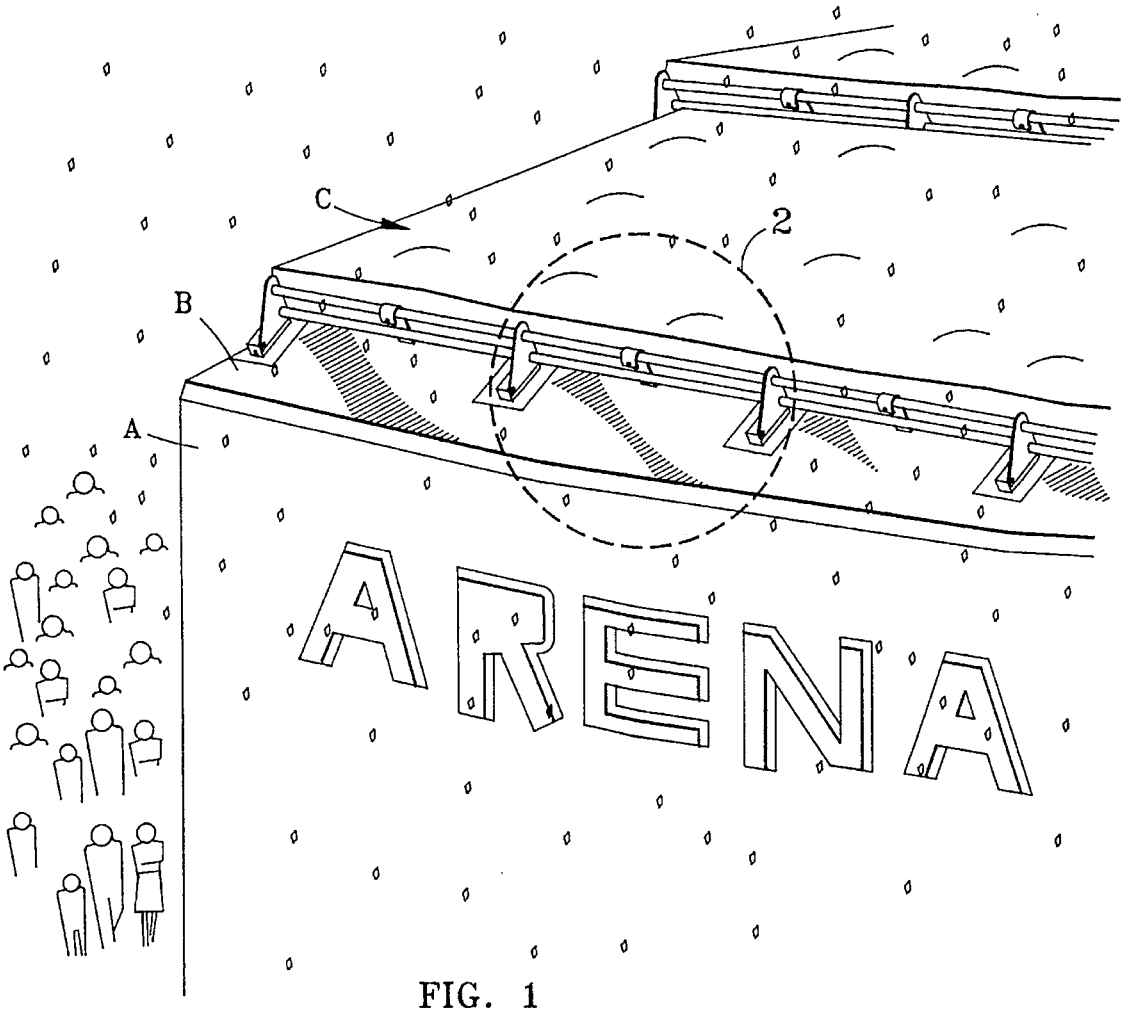

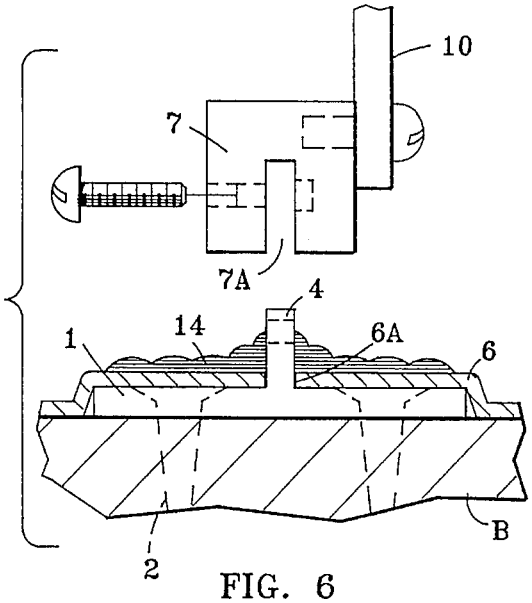
FIG. 6
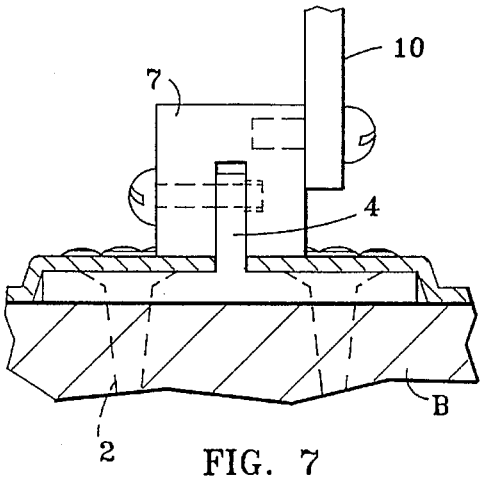
FIG. 7
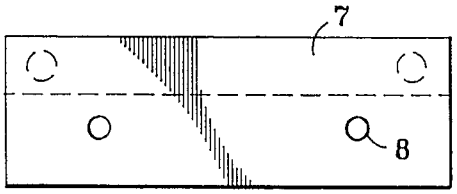
FIG. 8
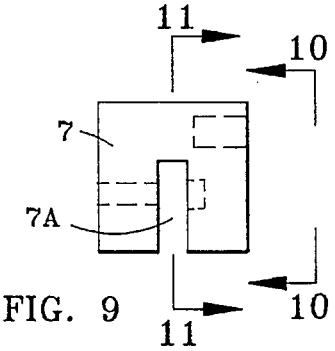
FIG. 9
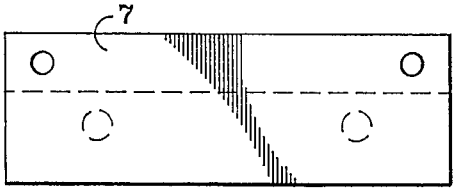
FIG. 10
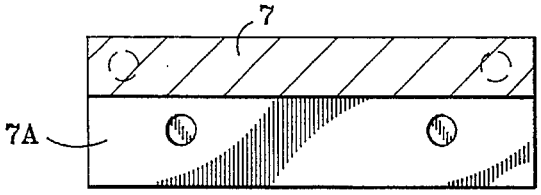
FIG. 11
FIG. 12
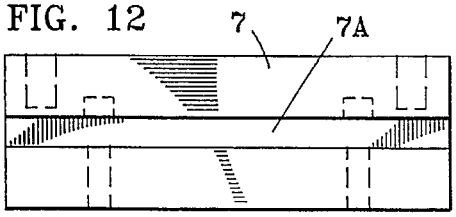
FIG. 12A
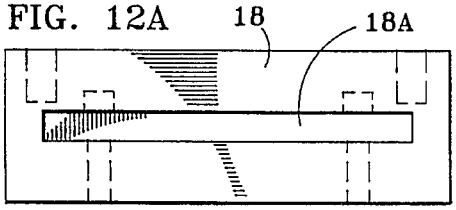
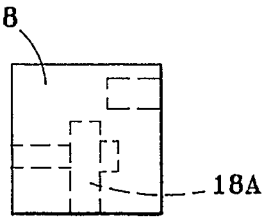
FIG. 13

IMPERVIOUS MEMBRANOUS ROOF SNOW FENCE SYSTEM

FEDERALLY SPONSORED RESEARCH AND DEVELOPMENT

There is no federally sponsored research and development in respect of the instant invention.

CROSS REFERENCES TO PRIOR APPLICATIONS

There are no prior or parent applications relating to the instant application.

BACKGROUND OF THE INVENTION

1. Field of the Invention

The instant invention relates to those device and/or systems that serve to prevent snowloads from cascading off roofs and onto persons or structures below the edges of such roofs.

2. Prior Art

There are various currently in vogue snowguard mounting systems that serve to hold snowloads on so-called seamed roofs or metal roofs. There are some as well that could serve in a like capacity as well for membranous roofs. However, there are none that like the instant invention are impervious to moisture, a feature that is veritably essential where membranous roofs in particular are involved. One example of such a system currently within the ambit of arguably relevant art is a system involving plates with vertical splines mounted to roofs with mounting blocks affixed to the splines, fencing flags affixed top the blocks and fencing held by the flags. Such systems however by virtue of the manner in which they are designed invariably permit leakage of moisture down into the buildings covered by the roofs to which they are attached. Such system, for example, unlike the instant invention do not consist of such components and features as the mounting plate covers and isolated mounting block inner compartments which serve to militate so poignantly against the leakage of moisture into roofs to which the instant invention is attached.

A SUMMARY OF THE INVENTION

1. A Brief Description of the Invention

The instant invention consists of a series of six-sided mounting plates with a plurality of vertical through holes in them for purposes of affixing them to membranous roofs via suitable fixation means such as screws. Each mounting plate is also characterized by the presence of a vertical spline affixed to the top side of each. Each such plate is, in turn, covered by another component of the invention, namely a membranous patch with a horizontal slit in it such that when it is atop and about the borders of a mounting plate, the spline of the mounting plate fits through the slit. Such membranes covers are made up of rubber or vinyl material just as are membranous roofs. After coverage, each such cover is sealed to the roof. Each spline has two horizontal through holes. Affixed to each spline is a third component of the invention, namely a six-sided rectangularly shaped mounting block. Each mounting block has a hollow inner compartment extending from a bottom side into the body of the block for a first embodiment of the invention or a rectangularly shaped through sleeve for for a second embodiment into either of which each spline fits snug. Each block has two horizontal holes that match up with the holes in the spline so that the blocks can then be screwed fast to the splines. Each block also has two more tapped holes so that fence flag mounting components of the invention, one per mounting block can be fastened to the mounting blocks. Each fence flag has holes in it for receipt of the horizontal fencing components of the invention as well as holes that line up with mounting block tapped holes for fastening them via means such as screws to the blocks. Between each of a plurality of such flags along the length of a membranous roof affixed to one horizontal fence component is one of a plurality of vertical fence components curled at one end. A third embodiment of the invention contemplates mounting plates with vertically inclined threaded posts rather than splines and blocks with vertically inclined through holes rather than sleeves.

2. Objects of the Invention

The primary advantage of membranous roofing composed primarily of such materials as rubber or vinyl as contrasted with other types of roofing such as, for example, metallic roofing is that the former is essentially leakproof over virtually the whole useful life of such roofing. Such roofing also can be installed quickly in large sheets and requires no external fasteners in respect. of such installation, a feature that serves to even moreso add to the essentially invariate leakproof quality of such roofing. It is accordingly an object of the instant invention to effectively solve the problem of affixing an appropriate snowload holding fencing system to such roofing without at the same time derogating the leak proof quality of such roofing. Snowguard systems currently in vogue are inadequate to the task of preventing a propensity for leakage when affixed to such roofing. External fasteners endemic to such systems can be caulked, but such caulking eventually fails thus exposing a membranous roof to invariable leakage at fastening sites from snow, water or melting ice. The instant invention, consisting as it does of a plurality of fiat six-sided mounting plates that are fastened directly through the roofing to the roof deck below which mounting plates are characterized by the presence of either a vertical spline in two embodiments or threaded posts in a third embodiment affixed thereto, is readily amenable to being covered as respect each plate with a series of membranous covers of patches over the whole of each mounting plate with a slit or holes within each to accommodate the splines or posts on the plates protruding up through them. The patches are eminently amenable to being permanently sealed to the surface of the roofing, and, once the invention's mounting block components are affixed to the splines or posts via the blocks inner sleeves in two embodiments or threaded holes in a third embodiment, assurance against eventual leakage subsequent to installation is complete. Also, in the face of never ending concerns for the safety of workmen on any roof, the invention is also eminently suitable for service as an extremely effective endroof safety fence simply by modifying the size of its fencing flag components. Respectfully submitted, the instant invention, by virtue of its ability to hold snow loads on membranous roofs as well as to ensure that the imperviousness of such roofs can be effectively maintained subsequent to its affixation thereto together with its availability likewise for service as a safety fence is not only new, useful and unique but is indeed virtually revolutionary in the art of snow fencing affixed to membranous roofs.

A DESCRIPTION OF THE DRAWINGS

1. FIG. 1 shows the instant invention panoramically holding a snowload on the membranous roof of a building.

Figure 2:
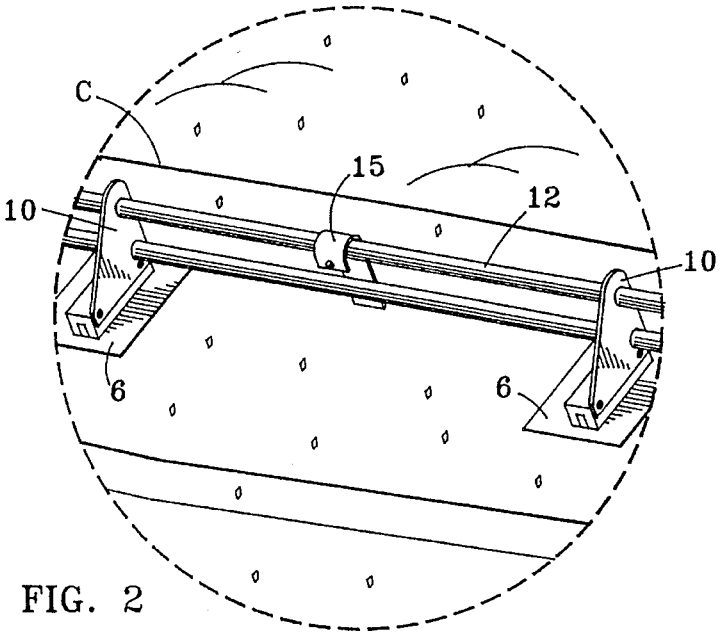

2. FIG. 2 is an isolated close-up view of a portion of one embodiment of the invention as seen in FIG. 1.

Figure 3:
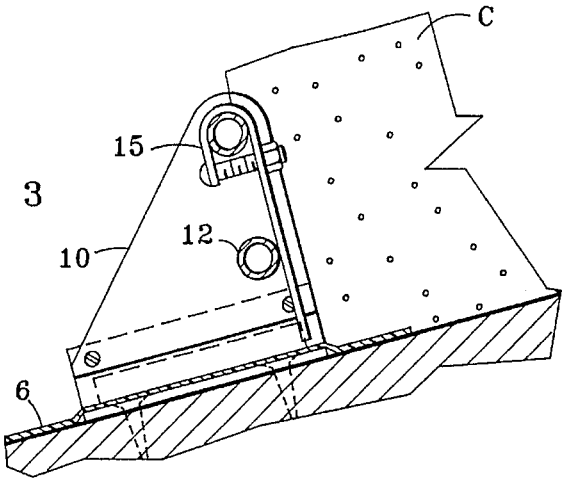

3. FIG. 3 is a lateral cross-sectional view of a portion of one embodiment of the invention fastened through membranous roofing to a roof deck below and shown holding back snow.

Figure 4:
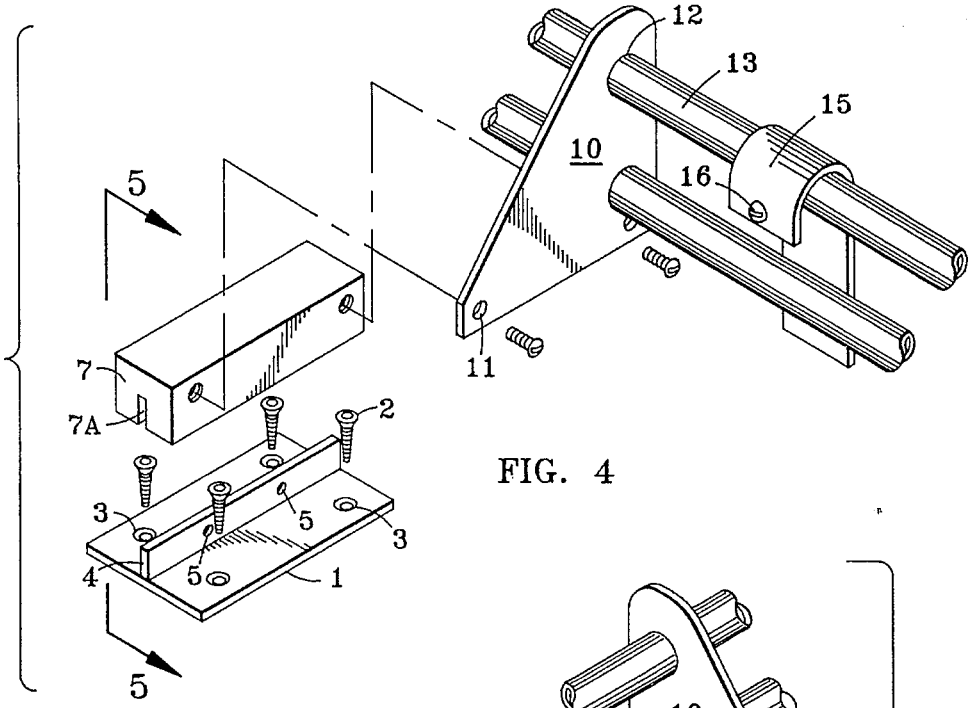

4. FIG. 4 is an exploded perspective view of one of one embodiment of the invention's mounting plate components, one of its mounting block components, one of its fencing flag components, a portion of its horizontal fencing and one of its vertical fencing units.

Figure 5:
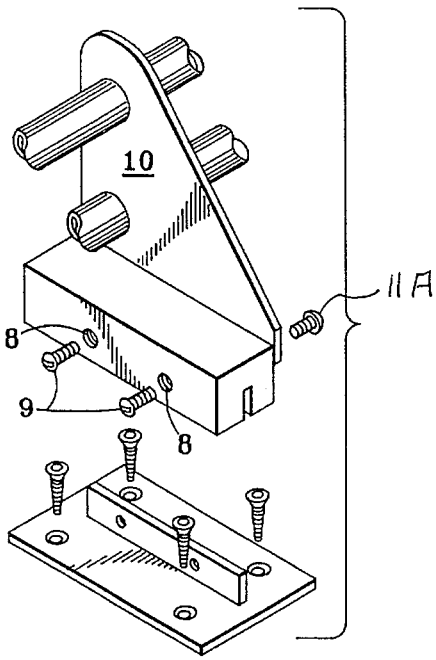

5. FIG. 5 is a left sided exploded perspective view of what is seen in FIG. 4.

6. FIG. 6 is an exploded cross-sectional frontal view of one of one embodiment's mounting plates covered with a membranous patch and affixed to membranous roofing after sealing of the patch and a corresponding mounting block showing holes and screws evidencing the contemplated mode of assembly of these components and a fencing flag component. Optional caulking atop the patch is also seen.

7. FIG. 7 is a cross-sectional frontal view showing assembly of the components seen in FIG. 6.

8. FIG. 8 is a left sided plan view of one of the mounting block components of one embodiments of the invention.

9. FIG. 9 is a frontal plan view of one of the mounting block components of one embodiment of the invention.

10. FIG. 10 is a right sided plan view of one of the mounting block components of one embodiment of the invention.

11. FIG. 11 is a cross-sectional view of what is seen in FIG. 10.

12. FIG. 12 is a bottom plan view of one of the mounting block components of one embodiment of the invention, namely one with an anteroposterior sleeve.

12A. FIG. 12A is a bottom plan view of one of the mounting block components of a second embodiment of the invention, namely one with a hollow inner compartment.

13. FIG. 13 is a frontal plan view of the variant of the mounting block components of the invention, previously seen in FIG. 12A.

Figure 14:
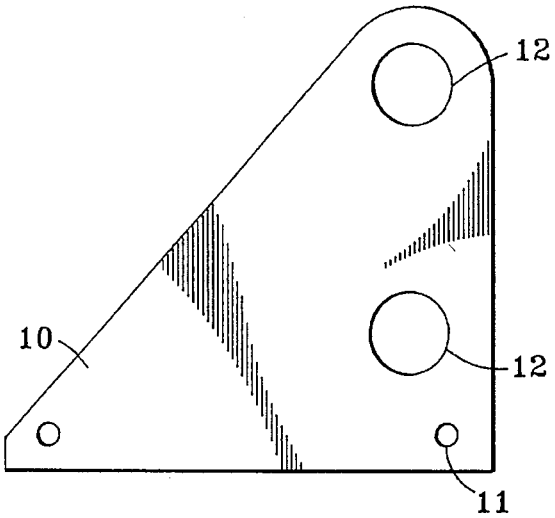

14. FIG. 14 is a lateral plan view of one of the invention's fencing flags.

Figure 15:
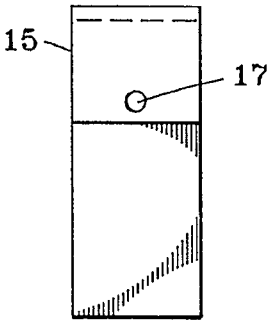

15. FIG. 15 is a frontal plan view of one of the invention's vertical fencing components.

Figure 16:
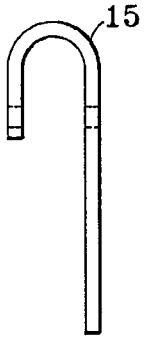

16. FIG. 16 is a lateral plan view of one of the invention's vertical fencing components.

Figure 17:
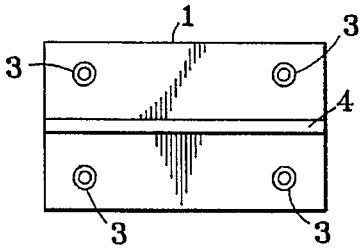

17. FIG. 17 is a top plan view of a mounting plate component of each of two embodiments of the invention.

Figure 18:
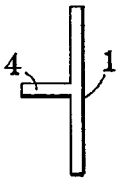

18. FIG. 18 is an end plan view of a mounting plate component of each of two embodiments of the invention.

Figure 19:
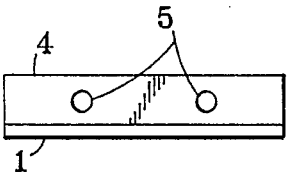

19. FIG. 19 is a lateral plan view of a mounting plate component of each of two embodiments of the invention.

Figure 20:
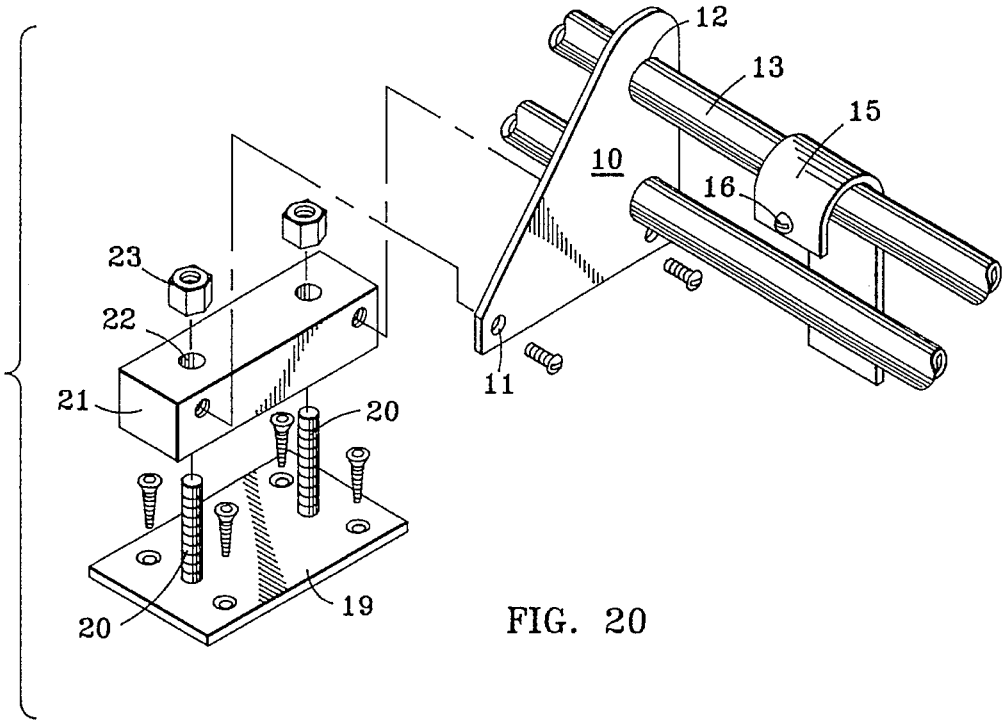

20. FIG. 20 is an exploded perspective view of one of the mounting plate components, one of the mounting block components, one of the fencing flag components and a portion of the fencing of a third embodiment of the invention.

Figure 21:
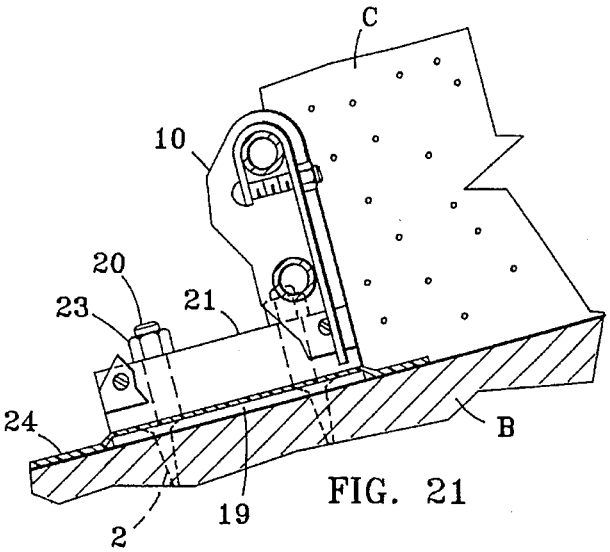

21. FIG. 21 is a lateral cross-sectional view of a portion of the third embodiment of the invention fastened through membranous roofing to a roof deck below and shown holding snow.

Figure 22:
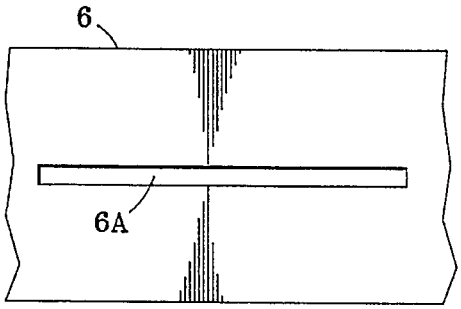

22. FIG. 22 shows a membranous patch in top view with a slit on it.

Figure 23:
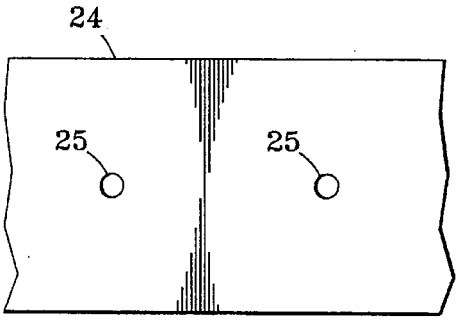

23. FIG. 23 Shows a membranous patch in top view with a plurality of through holes on it.

Figure 24:
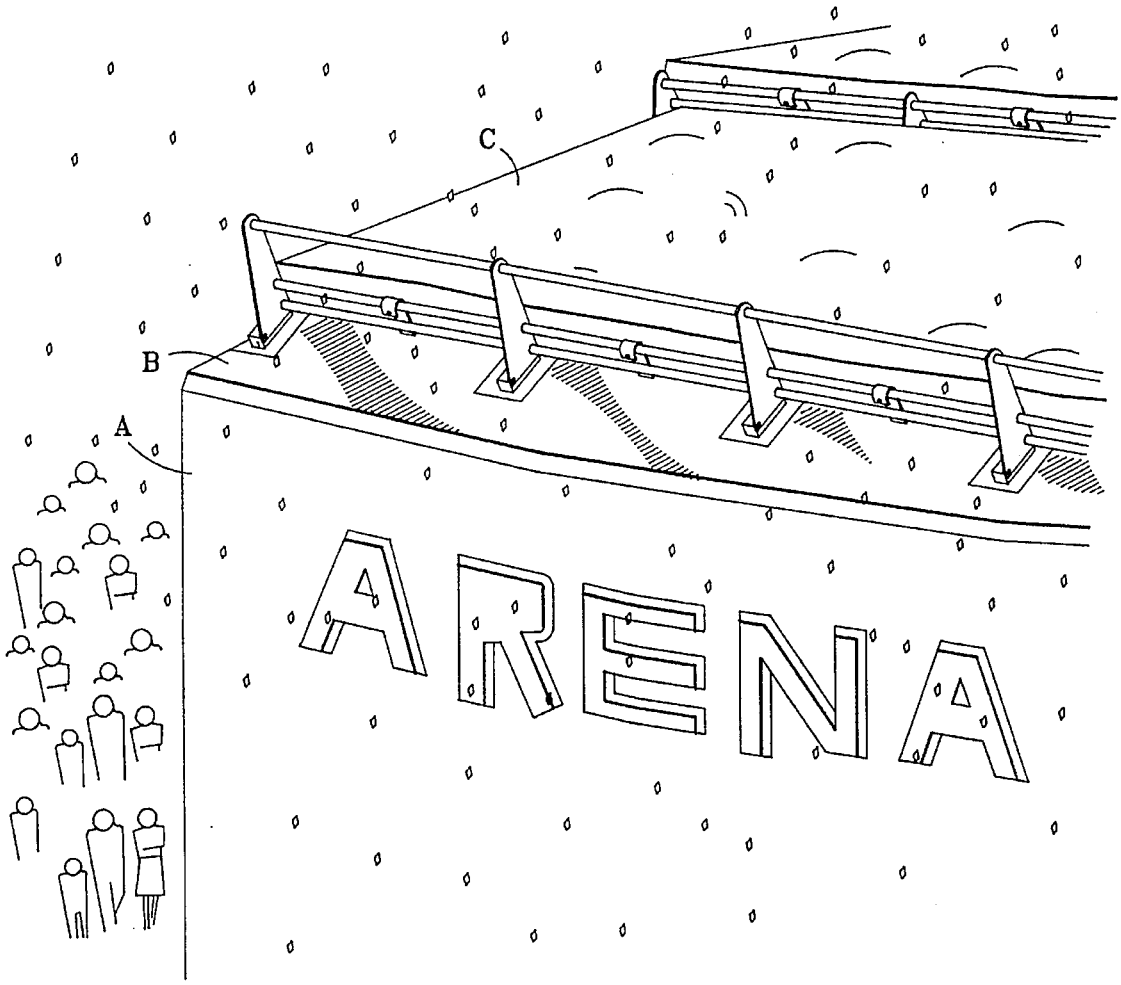

24. FIG. 24 shows a portion of the instant invention panoramically affixed to a membranous roof on a building evidencing its ready availability as a safety fence.

A DESCRIPTION OF THE PREFERRED EMBODIMENT

FIG. 1 shows the intact instant invention at two locations upon a membranous roof B atop a building A holding a snowload C. Falling snow and ice are perpetual problem as respects roofs throughout especially the northern United States of America. Snow fencing system are typically found along the location upon roofing some eighteen plus inches or so above the eavesdrop of such roofing. This is because it is at this point on roofing at the advent of any overhang where ice is most likely to build up if at all. It is here that building heat can still reach the roofing. Such heat does not reach overhang or roofing at or near the point of such roofing's eavesdrop. Also, generally speaking, another exemplar of the instant invention will be found some fifteen or so feet above the locus of the first exemplar. Such is typically the case, since, the dependable loadholding capacity of one completely exemplar of the invention fully assembled and mounted to a membranous roof as respects a snowload C that is, for example, a foot and one-haft high or so is the weight of such a load with fifteen feet or so of depth. Roof B is a membranous roof, a roof characterized by a rubber or vinyl essence that goes down quickly in large sheets and that is virtually leakproof perforce of a lack of need for external fasteners that are prone to facilitate leakage of water from snow, ice or rain to a roof deck just below such roofing. Such fasteners are clearly required indeed much moreso when metallic roofing rather than membranous roofing is in use. Moreover, the propensity for eventual leakage in the case of shingled roofing is fairly self-evident. FIG. 2 is an isolated close up view of a portion of one exemplar of the fully assembled embodiment of the invention mounted to a roof B. FIG. 3 is a lateral cross-sectional view of one of the invention's plurality of fiat six sided mounting plates 1 also seen in FIGS. 17, 18 and 19 which are mounted via mounting means 2 through a plurality of vertical through holes 3 as seen in FIG. 4 to the decking below a roof B. Centrally affixed anteroposteriorly to each plate 1 is a spline 4 characterized by the presence of a plurality of horizontal through holes 5 as seen in FIGS.. 4 and 5. Once each plate 1 is anchored to a roof B as noted above, one of a plurality of membranous covers or patches 6 seen in FIG. 22 corresponding one to each plate 1 with a slit 6A in it to accommodate extrusion of a spline 4 is placed over each plate 1 and sealed to roof B such patches are typically composed of the same types of materials as membranous roofing, namely, rubber or vinyl type materials. A plurality of six sided mounting blocks 7 with anteroposterior centrally positioned sleeves 7A and horizontal tapped holes 8 as seen in FIG. 5 are mounted on to each mounting plate 1 by way of receipt of spline 4 into sleeves 7A and by way of mounting means 9 screwed into holes 8 and 5 once each mounting plate 1 has been covered over by one each of a patch 6. One of a plurality of fencing flag mounts 10 with a plurality of horizontal through holes 11 as seen in FIGS. 4, 5 and 14 are mounted to mounting block 7, one flag 10 per mounting blocks 7 via mounting means 11A. Each flag 10 in turn has a plurality of fencing holes 12 as seen in FIG. 14 for insertion of a plurality of horizontal fencing components 13 as seen in FIGS. 3, 4 and 5. FIG. 6 shows roof B to which plate 1 has been mounted by way of mounting means 2. Plate 1 is seen covered by a patch 6. Extruding upwards through a slit 6A in patch 6 is spline 4. This portion of the invention, namely the combination of a plate 1 mounted via means 2 to roof B and then covered by a patch 6 thereafter sealed to roof B is the manner in which a snow fencing system can be effectively anchored to a leakproof membranous roof B without compromising the leakproof character of such a roof B. This combination obviates the eventual passage of moisture by way of capillary action or corrosion about an external fastener through such a hitherto leakproof roof to a roof deck below thereby obviating any concern for eventual internal i.e., ceiling damage from moisture. Optional caulking 14 also seen atop patch 6 in FIG. 6 can be utilized in order to further allay any concerns one might have about any remote possibility of the eventual emergence of a leak in a membranous roof at or about the points of insertion of mounting means 2 into roof B. Shown affixed to one piece of horizontal fencing 13 in FIG. 2 is a piece of curled vertical fencing 15 mounted thereto by way of mounting means 16 inserted through a hole 17 in such vertical fencing. Such vertical fencing units shown in isolated view in FIGS. 15 and 16 facilitate the holding of snow loads even more efficaciously than would horizontal pieces of fencing 13 alone. FIG. 7 evidences how a mounting block 7 is held via mounting means 9 to a spline 4 and how a fencing flag mount 10 is held by mounting means 12 to a mounting block 7. FIGS. 8, 9, 10 and 11 are various views of a mounting block 7. FIG. 12A is a bottom view of a mounting block 18 which is identical to a mounting block 7 but for the fact that instead of possessing an anteroposterior sleeve 7A, a mounting block 18 possesses a hollow inner compartment 18A for receipt of a spline 4. FIGS. 12A and 13, bottom plan and frontal views respectively as contrasted with FIGS. 9 and 12 help one to further appreciate the difference these two mounting block variants. A second and most preferred embodiment of the instant invention exists when mounting blocks 18 instead of mounting blocks 7 are utilized as noted above. FIG. 20 shows a mounting plate 19 which differs from mounting plate 1 only insomuch as it is characterized by the presence of affixed threaded posts 20 instead of a spline 4. A mounting block 21 therein shown is identical to mounting blocks 7 and 18 except for the presence of vertical clearance holes 22 in lieu of a sleeve 7A or inner compartment 18A and is mounted to posts 20 via nut means 23. Affixation of fencing flag mounts 10 to blocks 21 and support of fencing components 13 and in turn components 15 is the same as respects such affixation to blocks 7 or blocks 18. FIG. 21 shows this, a portion of a third embodiment of the invention with a membranous cover patch 24 over a plate 19 but under a block 21 which block 21 is shown holding fencing flag mount 10. A membranous patch 24 seen in FIG. 23 differs from a membranous patch 6 in that, instead of a slit 6A therein to accommodate extrusions through of a spline 4, there are two holes 25 therein to accommodate threaded posts 20. FIG. 24 shows how any one of these three embodiments of the invention can be utilized not only as a snowload holder but indeed also as a safety fence at the first roof B level beyond the eavesdrop edge of roof B simply by enhancing the size and height of fencing flag mounts 10. Such a safety fence can indeed very effectively prevent a workman from inadvertently falling off a roof after slipping thereupon near such a roof B's eavesdrop edge. In respect of the foregoing, it is indeed worth noting as well that the combination of plate 1 with mounting means 2 and holes 3 along with membranous patch 6 all mounted and sealed to roof B as well as the combination of plate 19 with mounting means 2 and holes 3 along with membranous patch 2 all mounted and sealed to roof B both serve equally well as fixation anchors on membranous roof B where it is clearly desired to maintain the waterproof integrity of such roof B's notwithstanding such fixation. Finally, it should be noted also that mixed combinations of plates 1 with patches 6 and blocks 7 or 18 and/or of plates 19 with patches 24 and blocks 21 can be utilized for purposes of mounting fencing flag mounting units 10 and fencing as noted above.

What is claimed is:

1. An impervious membranous roof snow fence system comprising:

(a) a plurality of flat six sided mounting plates wherein each of the mounting plates is adapted to lie against a surface of roofing;

(b) a plurality of vertical through holes extending through said each mounting plate;

(c) means for fastening said each mounting plate via said through holes through said roofing to a roof deck below said roofing;

(d) a vertically inclined spline affixed to said each mounting plate;

(e) a plurality of membranous patches wherein each of said membranous patches is fitted over said each mounting plate, said each membranous patch having a top surface area greater than a top surface area of said each mounting plate and also having a slit thereon for allowing said spline to protrude therethrough;

(f) means for completely sealing said each membranous patch covering said mounting plate with the spline protruding through the slit to prevent moisture from reaching the roofing surface; and (g) a fencing structure including means for securing said fencing structure onto said mounting plates.

2. The impervious membranous roof snow fence system of claim 1, wherein said means for sealing comprises a caulking material which is spread on the top surface of said each membranous patch and said spline.

3. An impervious membranous roof snow fence system comprising:

(a) a plurality of flat six sided mounting plates wherein each of the mounting plates is adapted to lie against a surface of roofing;

(b) a plurality of vertical through holes extending through said each mounting plate;

(c) means for fastening said each mounting plate via said through holes through said roofing to a roof deck below said roofing;

(d) a plurality of vertically inclined threaded posts affixed to said each mounting plate;

(e) a plurality of membranous patches wherein each of said membranous patches is fitted over said each mounting plate, said each membranous patch having a top surface area greater than a top surface area of said each mounting plate and also having a plurality of holes thereon for allowing said threaded posts to protrude therethrough;

(f) means for completely sealing said each membranous patch covering said mounting plate with the threaded posts protruding through said patch holes to prevent moisture from reaching the roofing surface; and (g) a fencing structure including means for securing said fencing structure onto said mounting plates.

4. The impervious membranous roof snow fence system of claim 3, wherein said means for sealing comprises a caulking material which is spread on the top surface of said each membranous patch and said threaded posts.

5. An impervious membranous roof snow fence system comprising:

(a) a plurality of flat six sided mounting plates wherein each of the mounting plates is adapted to lie against a surface of roofing;

(b) a vertically inclined spline affixed to said each mounting plate;

(c) a plurality of through holes extending through top and bottom sides of said each mounting plate;

(d) means for fastening said each mounting plate via said through holes through said roofing to a roof deck below said roofing;

(e) a plurality of horizontal through holes extending through said spline;

(f) a plurality of six sided mounting blocks wherein each of the mounting blocks has a hollow inner compartment for receipt of said spline;

(g) a plurality of primary horizontal tapped holes in said each mounting block, said tapped holes being aligned with said horizontal through holes of the spline when said spline is received within the hollow inner compartment of said mounting block;

(h) means for fastening said each mounting block to said spline via said primary horizontal tapped holes and said spline through holes;

(i) a plurality of membranous patches wherein each of said membranous patches is fitted over said each mounting plate, said each membranous patch having a top surface area greater than a top surface area of said each mounting plate and also having a slit thereon for allowing said spline to protrude therethrough;

(j) means for completely sealing said each membranous patch covering said mounting plate with the spline protruding through the slit to prevent moisture from reaching the roofing surface;

(k) a plurality of fencing mounting units wherein each of said fencing mounting units has a plurality of fastening holes extending therethrough;

(l) a plurality of secondary horizontal tapped holes in said each mounting block on a side of said mounting block opposite a side of said mounting block having said primary horizontal tapped holes, wherein said fastening holes of the mounting units being aligned with said secondary horizontal tapped holes;

(m) means for fastening said each fencing mounting unit to said each mounting block via said secondary horizontal tapped holes and said fastening holes;

(n) a plurality of horizontal fencing units secured to said each fencing mounting unit; and (o) a plurality of vertical fencing units wherein each of said vertical fencing units has a curled end for securing onto said horizontal fencing units.

6. The impervious membranous roof snow fence system of claim 5, wherein said means for sealing comprises a caulking material which is spread on the top surface of said each membranous patch and said spline.

7. An impervious membranous roof snow fence system comprising:

(a) a plurality of flat six sided mounting plates wherein each of the mounting plates is adapted to lie against a surface of roofing;

(b) a vertically inclined spline affixed to said each mounting plate;

(c) a plurality of through holes extending through top and bottom sides of said each mounting plate;

(d) means for fastening said each mounting plate via said through holes through said roofing to a roof deck below said roofing;

(e) a plurality of horizontal through holes extending through said spline;

(f) a plurality of six sided mounting blocks wherein each of the mounting blocks has a hollow sleeve extending from front side to back side of said each mounting block for receipt of said spline;

(g) a plurality of primary horizontal tapped holes in said each mounting block, said tapped holes being aligned with said horizontal through holes of the spline when said spline is received within the hollow sleeve of said mounting block;

(h) means for fastening said each mounting block to said spline via said primary horizontal tapped holes and said spline through holes;

(i) a plurality of membranous patches wherein each of said membranous patches is fitted over said each mounting plate, said each membranous patch having a top surface area greater than a top surface area of said each mounting plate and also having a slit thereon for allowing said spline to protrude therethrough;

(j) means for completely sealing said each membranous patch covering said mounting plate with the spline protruding through the slit to prevent moisture from reaching the roofing surface;

(k) a plurality of fencing mounting units wherein each of said fencing mounting units has a plurality of fastening holes extending therethrough;

(l) a plurality of secondary horizontal tapped holes in said each mounting block on a side of said mounting block opposite a side of said mounting block having said primary horizontal tapped holes, wherein said fastening holes of the mounting units being aligned with said secondary horizontal tapped holes;

(m) means for fastening said each fencing mounting unit to said each mounting block via said secondary horizontal tapped holes and said fastening holes;

(n) a plurality of horizontal fencing units secured to said each fencing mounting unit; and (o) a plurality of vertical fencing units wherein each of said vertical fencing units has a curled end for securing onto said horizontal fencing units.

8. The impervious membranous roof snow fence system of claim 7, wherein said means for sealing comprises a caulking material which is spread on the top surface of said each membranous patch and said spline.

9. An impervious membranous roof snow fence system comprising:

(a) a plurality of flat six sided mounting plates wherein each of the mounting plates is adapted to lie against a surface of roofing;

(b) a plurality of vertically inclined threaded posts affixed to said each mounting plate;

(c) a plurality of through holes extending through top and bottom sides of said each mounting plate;

(d) means for fastening said each mounting plate via said through holes through said roofing to a roof deck below said roofing;

(e) a plurality of six sided mounting blocks wherein each of the mounting blocks has a plurality of vertical through holes for receipt of said threaded posts;

(f) nut means engageable with said threaded posts for fastening said each mounting block to said threaded posts;

(g) a plurality of membranous patches wherein each of said membranous patches is fitted over said each mounting plate, said each membranous patch having a top surface area greater than a top surface area of said each mounting plate and also having a plurality of holes thereon for allowing said threaded posts to protrude therethrough;

(h) means for completely sealing said each membranous patch covering said mounting plate with the threaded posts protruding through the patch holes to prevent moisture from reaching the roofing surface;

(i) a plurality of fencing mounting units wherein each of said fencing mounting units has a plurality of fastening holes extending therethrough;

(j) a plurality of horizontal tapped holes in said each mounting block wherein said fastening holes of the mounting units being aligned with said horizontal tapped holes;

(k) means for fastening said each mounting unit to said each mounting block via said horizontal tapped holes and said fastening holes;

(l) a plurality of horizontal fencing units secured to said each fencing mounting units; and (m) a plurality of vertical fencing units wherein each of said vertical fencing units has a curled end for securing onto said horizontal fencing units.

10. The impervious membranous roof snow fence system of claim 9, herein said means for sealing comprises a caulking material which is spread on the top surface of said each membranous patch and said threaded posts.

* * * * *